US005369813A

United States Patent [19]

Goddard et al.

[11] Patent Number: 5,369,813

[45] Date of Patent: Dec. 6, 1994

[54] SELF-CONTAINED TOILET VENTING SYSTEM

[76] Inventors: Lewis W. Goddard, 4069 S. Pacific Hwy. Space 50, Medford, Oreg. 97501; Edward J. McAteer, 3333 Beard Rd., Fremont, Calif. 94555

[21] Appl. No.: 164,929

[22] Filed: Dec. 10, 1993

[51] Int. Cl.[5] ..... E03D 9/052

[52] U.S. Cl. ..... 4/213

[58] Field of Search ..... 4/213

[56] References Cited

U.S. PATENT DOCUMENTS

| | | | |
|---|---|---|---|
| 3,763,505 | 10/1973 | Zimmerman | 4/213 X |
| 3,781,923 | 1/1974 | Maisch et al. | 4/213 |
| 3,913,150 | 10/1975 | Poister et al. | 4/213 |
| 4,031,574 | 6/1977 | Werner | 4/213 |
| 4,103,370 | 8/1978 | Arnold | 4/213 |
| 4,153,956 | 5/1979 | Fischer, Sr. et al. | 4/213 |
| 4,344,194 | 8/1982 | Pearson | 4/213 |
| 4,583,250 | 4/1986 | Valarao | 4/213 |
| 4,864,664 | 9/1989 | Higgins | 4/213 |
| 4,998,299 | 3/1991 | Menge | 4/349 |
| 5,125,119 | 6/1992 | Munoz | 4/213 |

*Primary Examiner*—Robert M. Fetsuga

*Attorney, Agent, or Firm*—Rhodes & Ascolillo

[57] ABSTRACT

In a preferred embodiment, a self-contained toilet ventilation system for retrofitting to an existing toilet installation, the toilet installation comprising a bowl, a water tank attached to the bowl, a tank interior air volume disposed within the tank, a bowl interior volume disposed within the bowl, and an overflow pipe connecting the tank interior air volume to the bowl interior volume, the system comprising an odor removing filter for reducing airborne odors, a motive fan for forcing air from the bowl interior air volume, through the overflow pipe, through the tank interior air volume, through the odor removing filter, and out of the system, and a mounting structure for housing the odor removing filter and the motive fan, the mounting structure being disposed on an upper edge of the water tank.

1 Claim, 2 Drawing Sheets

SELF-CONTAINED TOILET VENTING SYSTEM

BACKGROUND OF THE INVENTION

1. Field of the Invention

The present invention relates to sanitary toilets generally and, more particularly, but not by way of limitation, to a novel ventilation system for such toilets that may be easily retrofitted to existing toilet installations.

2. Description of the Related Art

U.S. Pat. No. 3,913,150, issued Oct. 21, 1975, to Poister et al., describes a toilet stool ventilating means which includes an adapter plate mounted under the water tank of a toilet and having therein an opening disposed underneath the toilet seat. A blower disposed underneath the adapter plate, or in the water tank, draws air into the opening, through a charcoal filter, and then discharges the air into the room or outside. It can be seen that the device described requires modification of an existing toilet installation.

U.S. Pat. No. 4,103,370, issued Aug. 1, 1978, to Arnold, describes an odorless water closet which comprises a relatively complicated, specially designed toilet having seals and air gathering means.

U.S. Pat. No. 4,864,664, issued Sep. 12, 1989, to Higgins, describes a vent system for a toilet which includes a blower mounted in the water tank of the toilet. The blower draws air through openings in the lower surface of a hollow toilet seat and discharges the air through a passage in the toilet to a soil pipe below the siphon chamber of the toilet. A self-filling water seal is provided within the water tank to prevent foul air from blowing back into the toilet. The system described requires the use of a specially constructed toilet.

U.S. Pat. No. 4,998,299, issued Mar. 12, 1991, to Menge, describes a toilet with apparatus for evacuating malodorous air from the bowl which includes a specially designed water tank having therein an air evacuation apparatus and a special water/air valving apparatus. During use of the toilet and before the flushing thereof, air is drawn from the toilet bowl through the flushing connection thereto and is discharged into the vent flue connected to the soft pipe. When it is desired to flush the toilet, the air system is valved off and water enters the toilet bowl in the normal manner through the flushing connection.

U.S. Pat. No. 5,125,119, issued Jun. 30, 1992, to Munoz, describes an odor reduction toilet apparatus which, in one embodiment, shows an exhaust fan mounted above the ceiling of the room in which the toilet is installed and connected to the overflow pipe in the water tank. The fan is connected to the overflow pipe by a tube which passes through a hole cut in the rear wall of the water tank. In another embodiment, a fan housing is suspended in the water tank by means of hooks engaging the upper edge of the rear wall of the water tank, and the fan housing is attached to the top of the overflow pipe by uncertain means. The fan blows air against a cache of deodorizer, capturing some of the deodorizer in the air, and the air then blows into the toilet bowl. The arrangement is intended to provide deodorized air within the toilet bowl, but the flow of air out of the toilet bowl around the seat thereof would appear to aggravate the odor problem for anyone using the toilet, as well as creating an unpleasant draft.

Everyone is familiar with the odors that can exist around toilet installations. Many of these odors emanate directly from the present use of the toilets, but other odors result from poorly cleaned toilets and any associated bacteria growing therein. There have been many attempts to solve the problem of such odors, the simplest being to hang a deodorizing device near the toilet or in the toilet bowl. Another type of solution is a room exhaust fan. A particular disadvantage of the latter is that a large flow of air is required, since a whole room must be ventilated. This can cause an unpleasant draft, objectionable noise, and increased heating costs during cold weather. An additional type of solution is to install an air gathering device around or under the toilet seat, or to replace the existing toilet seat with a special device, or otherwise provide a means to draw the air from the toilet bowl.

Some of the aforementioned systems require specially designed toilets, and none of the above systems can be retrofitted to an existing toilet without some modification of the toilet.

SUMMARY OF THE INVENTION

Accordingly, it is a principal object of the present invention to provide a toilet ventilation system which is self-contained. It is a further object of the invention to provide such a system which is simply and economically constructed.

It is an additional object of the invention to provide such a system that can be retrofitted to an existing toilet installation without modification thereof.

Other objects of the present invention, as well as particular features, elements, and advantages thereof, will be elucidated in, or be apparent from, the following description and the accompanying drawing figures.

The present invention achieves the above objects, among others, by providing, in a preferred embodiment, a self-contained toilet ventilation system for retrofitting to an existing toilet installation, the toilet installation comprising a bowl, a water tank attached to the bowl, a tank interior air volume disposed within the tank, a bowl interior volume disposed within the bowl, and an overflow pipe connecting the tank interior air volume to the bowl interior volume.

The self-contained toilet ventilation system comprises an odor removing means for reducing airborne odors, a motive means for forcing air from the bowl interior air volume, through the overflow pipe, through the tank interior air volume, through the odor removing means, and out of the system, and a mounting means for housing the odor removing means and the motive means, the mounting means being disposed on an upper edge of the water tank.

The motive means preferably comprises an electric fan disposed in the mounting means, a battery pack for powering the electric fan, the battery pack being removably attached to the mounting means, and a switch for controlling the electric fan, the switch being disposed on an outer surface of the mounting means. The switch may further comprise a timing mechanism and a knob mechanism for selecting a desired duration for operating the system.

The odor removing means preferably comprises an odor-sorbent bed removably attached to the mounting means, the odor-sorbent bed being disposed interiorly of the mounting means. The odor-sorbent bed is preferably an activated charcoal bed.

The mounting means further comprises a plurality of horizontal members disposed interiorly of the system, a plurality of spacer members disposed between the plurality of horizontal members for enhancing flow of the air through the system, and a lid removably disposed on top of the plurality of horizontal members and the plurality of the spacer members.

The self-contained toilet ventilation system further comprises: a horizontal bottom member dimensioned to extend over and completely engage an upper edge of the water tank; an air intake opening defined through the horizontal bottom member for enabling air to move from the tank interior air volume into the self contained toilet ventilation system; a lower intermediate horizontal member, attached to and spaced apart from the bottom member by means of first edge spacers extending fully around an upper periphery thereof; a fan opening defined through the lower intermediate member; first edge spacers fixedly attached to and extending fully around an upper periphery of the horizontal bottom member, the first edge spacers being fixedly attached to and extending fully around a lower periphery of the lower intermediate horizontal member, the first edge spacers spacing apart the horizontal bottom member and the lower intermediate horizontal member; second edge spacers fixedly and sealingly attached to and extending fully around an upper periphery of the lower intermediate member and an intermediate spacer extending across the lower intermediate member; resilient sealing strips fixedly and sealingly attached to and disposed fully along upper edges of the second edge spacers and the intermediate spacer; an upper intermediate horizontal member spaced apart from the lower intermediate member by means of the second spacers and the sealing strips, the upper intermediate member being removably placed on the sealing strips; a generally horizontal lid member extending over the foregoing elements and fixedly and sealingly attached to the upper intermediate horizontal member; an electric fan disposed in the fan opening, the electric fan extending upward through the upper intermediate member and extending downward through the air intake opening; a power means for providing electric power to the electric fan; and a bed of activated charcoal disposed in a space defined by the second edge spacers, the intermediate spacer, and the lower and upper intermediate members.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENT

Figure 1:
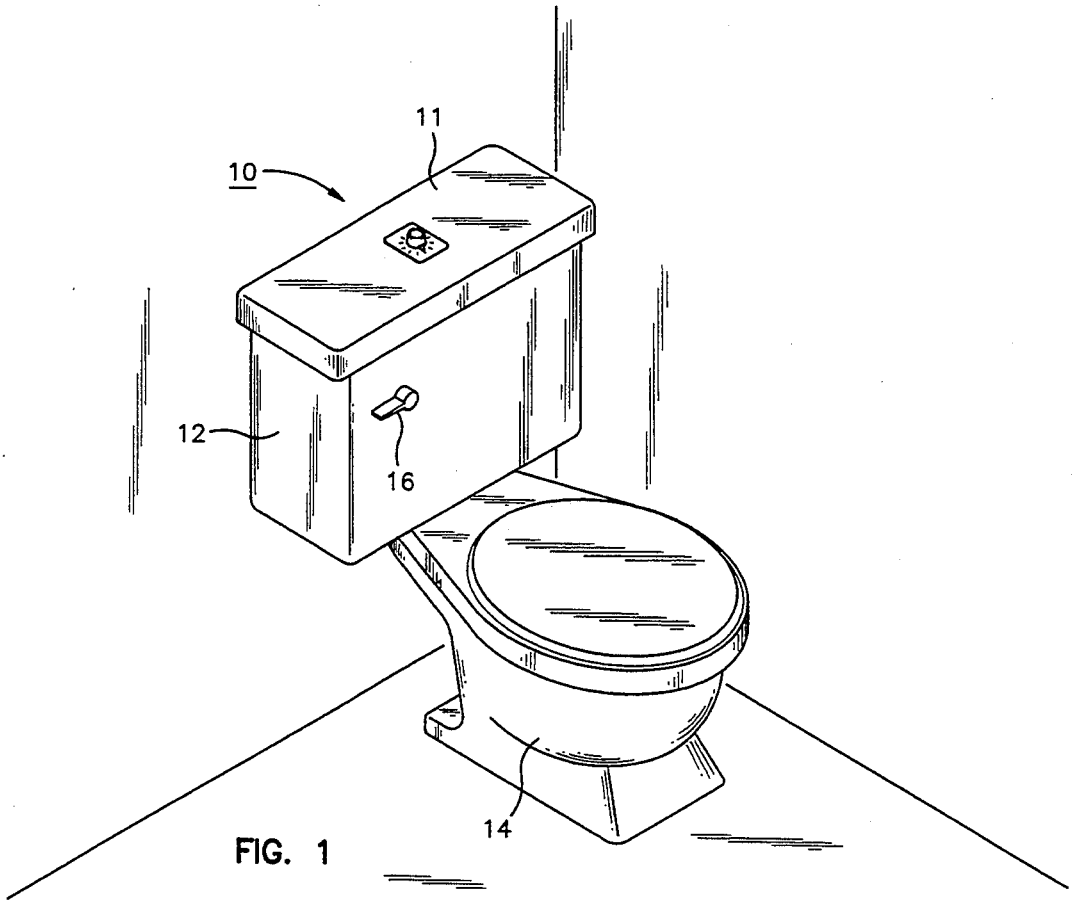
FIG. 1 is an isometric view of a toilet installation including the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Referring first to FIG. 1, there is illustrated the self contained toilet venting system of the present invention, generally indicated by the reference numeral 10, forming the top 11 of a conventional water tank 12 mounted on a conventional toilet bowl 14, the tank having a conventional flush lever 16.

Figure 2:
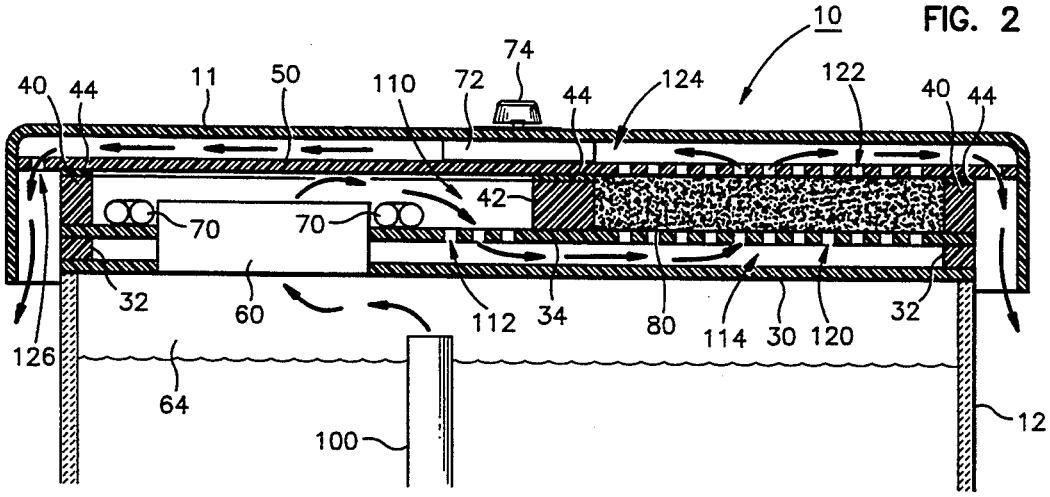
FIG. 2 is a fragmentary, front elevational view, partially in cross-section, of the present invention installed on the toilet.
Figure 3:
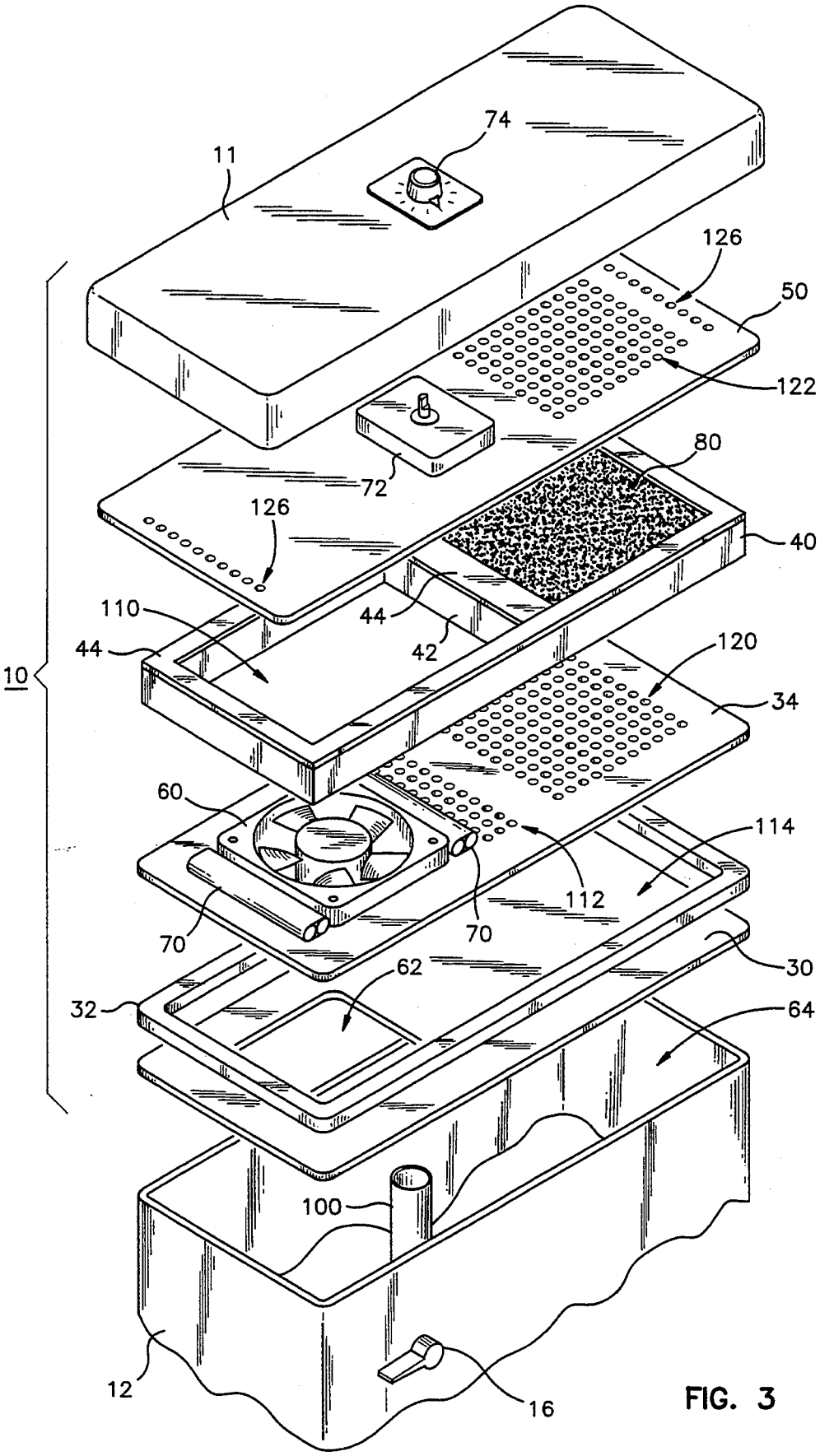
FIG. 3 is a fragmentary, exploded, isometric view of the elements of the present invention.

Reference should now be made to FIGS. 2 and 3 together for an understanding of the construction and operation of the present invention. System 10 includes a horizontal bottom member 30 dimensioned to extend over and fully engage the upper edge of water tank 12. Attached to and spaced apart from bottom member 30, by means of first edge spacers 32 extending around the upper periphery of the bottom member 30, is a lower intermediate horizontal member 34. Edge spacers 40 extend around the upper periphery of lower intermediate member 34 and an intermediate spacer 42 extends thereacross. Resilient sealing strips 44 are disposed on the upper edges of second edge spacers 40 and intermediate spacer 42. Adjacent elements of bottom member 30, first edge spacers 32, lower intermediate member 34, second edge spacers 40, intermediate spacer 42, and resilient sealing strips 44 are fixedly and sealingly attached to each other by suitable means such as with an adhesive.

Spaced apart from lower intermediate member 34, by means of second edge spacers 40 and sealing strips 44, is an upper intermediate horizontal member 50 which is fixedly attached to lid 11 around the peripheral edges of the upper intermediate horizontal member 50. Upper intermediate horizontal member 50 is removably placed on sealing strips 44.

An electric fan 60 is disposed through upper intermediate member 34 and, when system 10 is assembled (FIG. 2), the fan extends through an opening 62 (FIG. 3) defined through bottom member 30 for communication with the interior volume 64 of tank 12. Rechargeable battery packs 70 are provided on lower intermediate member 34 for powering electric fan 60 and a timer switch 72 which is mounted on upper intermediate member 50. A knob 74 extending above lid 11, is provided for the control of electricity to the fan. Alternatively, fan 60 and switch 72 could be arranged for connection to a wall outlet for electric power. An odor absorbing bed such as a bed of activated charcoal 80 is disposed between edge spacers 40, intermediate spacer 42, and lower and upper intermediate members 34 and 50, respectively.

In operation, and with particular reference to the air flow arrows on FIG. 2, timer switch 72 is turned on and fan 60 draws foul air from toilet bowl 14 through a conventional overflow pipe 100 in water tank 12 and blows the air into a space 110 defined between second edge spacers 40, intermediate spacer 42, and lower and upper intermediate members 34 and 50, then through a plurality of holes, as at 112, defined through lower intermediate member 34, and into a space 114 defined between first edge spacers 32 and bottom and lower intermediate members 30 and 34. The air then flows into charcoal bed 80 by first passing through a plurality of holes, as at 120, defined through lower intermediate member 34, and then exits the charcoal bed 80 through a plurality of holes, as at 122, defined through upper intermediate member 50, and then into a space 124 (FIG. 2) defined between the upper intermediate member and lid 11. The air then exits system 10 through a plurality of holes, as at 126, defined through upper intermediate member 50, the plurality of holes 126 being spaced outwardly from the ends of tank 12, and then into the surrounding air. Any odors in the air drawn from toilet bowl 14 have thus been removed or substantially reduced. Timer switch 72 may be left on to complete the selected timed period, or it may be manually turned off.

It will be understood that only a small volume of air is required to be treated, and there is no penalty paid in the form of increased heating costs.

The elements of system 10 may be constructed of any suitable materials and the major elements thereof may be economically formed by conventional injection molding techniques from a suitable polymeric material. Lid 10 may be distinctively decorative or it may blend in color and shape with tank 12 and bowl 14.

Installation of system 10 requires only that the existing water tank lid (not shown) be removed. Then, bottom member 30, with lower intermediate member 34 and the sub-elements thereof attached thereto, is sealed to the upper edge of water tank 12 with a suitable putty material (not shown). Upper intermediate member 50 with lid 11 attached thereto is then placed on sealing members 44. The installation of system 10 is completed easily and quickly and without modification to water tank 12 or bowl 14 or elements therein. Periodic replacement of activated charcoal 80 and replacement or recharging of battery packs 70 may be easily accomplished by lifting lid 11 and upper intermediate member 50 and then removing the charcoal and battery packs.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A self-contained toilet ventilation system for retrofitting to an existing toilet installation, said toilet installation comprising a bowl, a water tank attached to said bowl, a tank interior air volume disposed within said tank, a bowl interior volume disposed within said bowl, and an overflow pipe connecting said tank interior air volume to said bowl interior volume, said system comprising:

(a) a horizontal bottom member dimensioned to extend over and completely engage an upper edge of said water tank;

(b) an air intake opening defined through said horizontal bottom member for enabling air to move from said tank interior air volume into said self contained toilet ventilation system;

(c) a lower intermediate horizontal member;

attached to and spaced apart from said bottom member by means of first edge spacers extending fully around an upper periphery thereof;

(d) a fan opening defined through said lower intermediate member;

(e) said first edge spacers fixedly attached to and extending fully around an upper periphery of said horizontal bottom member, said first edge spacers being fixedly attached to and extending fully around a lower periphery of said lower intermediate horizontal member, said first edge spacers spacing apart said horizontal bottom member and said lower intermediate horizontal member;

(f) second edge spacers fixedly and sealingly attached to and extending fully around an upper periphery of said lower intermediate member and an intermediate spacer extending across said lower intermediate member;

(g) resilient sealing strips fixedly and sealingly attached to and disposed fully along upper edges of said second edge spacers and said intermediate spacer;

(h) an upper intermediate horizontal member spaced apart from said lower intermediate member by means of said second spacers and said sealing strips, said upper intermediate member being removably placed on said sealing strips;

(i) a generally horizontal lid member extending over said ventilation system and fixedly and sealingly attached to said upper intermediate horizontal member;

(j) an electric fan disposed in said fan opening, said electric fan extending upward through said upper intermediate member and extending downward through said air intake opening;

(k) power means for providing electric power to said electric fan;

(l) a bed of activated charcoal disposed in a space defined by said second edge spacers, said intermediate spacer, and said lower and upper intermediate members; and (m) an air passageway defined through said lower and upper intermediate horizontal members.

* * * * *